US005171010A

United States Patent [19]

Lanoue

[11] Patent Number: 5,171,010

[45] Date of Patent: Dec. 15, 1992

[54] GOLF BALL TEEING APPARATUS

[76] Inventor: Todd W. Lanoue, 429 White Pond Rd., Athol, Mass. 01331

[21] Appl. No.: 818,252

[22] Filed: Jan. 8, 1992

[51] Int. Cl.[5] ..... A63B 57/00

[52] U.S. Cl. ..... 273/32.5

[58] Field of Search ..... 273/32.5, 32 B

[56] References Cited

U.S. PATENT DOCUMENTS

| | | | |
|---|---|---|---|
| 1,902,682 | 3/1933 | Walrath | 273/32.5 |
| 2,609,198 | 9/1952 | Armstrong | 273/32.5 |
| 4,013,295 | 3/1977 | Braugham | 273/32.5 |
| 4,562,369 | 7/1985 | Phelps | 273/32.5 |
| 4,616,826 | 10/1986 | Trefts | 273/32.5 |
| 5,080,357 | 1/1992 | Wolf | 273/32.5 |

*Primary Examiner*—Theatrice Brown
*Attorney, Agent, or Firm*—Leon Gilden

[57] ABSTRACT

A ball support housing is pivotally mounted to a lower distal end of an associated support rod, wherein the support rod includes an ejector rod telescopingly directed therethrough biased in a raised orientation relative to the support housing, wherein a lower distal end of the ejector rod is mounted through the top of an associated golf ball receiving cup to receive a golf ball and tee member therewithin. Downward projection of the support rod effects pivotment of the golf ball receiving cup within the housing, and projection of the ejector rod within the support rod effects projection of the golf ball and associated tee member exteriorly of the golf ball receiving cup.

4 Claims, 4 Drawing Sheets

GOLF BALL TEEING APPARATUS

BACKGROUND OF THE INVENTION

1. Field of the Invention

The field of invention relates to golf ball tee apparatus, and more particularly pertains to a new and improved golf ball teeing apparatus wherein the same is directed to the unitary positioning of a golf ball and associated tee member in a golf ball course.

2. Description of the Prior Art

Golf ball teeing apparatus of various types have been utilized in the prior art of constructions relatively elaborate and are exemplified in the U.S. Pat. Nos. 4,714,250; 4,951,947; 3,904,200; 4,957,296; and 4,892,318. The apparatus of the prior art have heretofore failed to provide a unitary housing to afford protection of the golf ball and tees prior to use, wherein ejection of the golf ball and tee is arranged in a conveniental and expedient manner for use in the play of the game of golf and in this respect, the present invention substantially fulfills this need.

SUMMARY OF THE INVENTION

In view of the foregoing disadvantages inherent in the known types of golf ball teeing apparatus now present in the prior art, the present invention provides a golf ball teeing apparatus wherein the same utilizes a golf ball cup mounted within a housing to effect selective projection of the golf ball and associated tee relative to the housing and cup for mounting to an underlying ground surface. As such, the general purpose of the present invention, which will be described subsequently in greater detail, is to provide a new and improved golf ball teeing apparatus which has all the advantages of the prior art golf ball teeing apparatus and none of the disadvantages.

To attain this, the present invention provides a ball support housing pivotally mounted to a lower distal end of an associated support rod, wherein the support rod includes an ejector rod telescopingly directed therethrough biased in a raised orientation relative to the support housing, wherein a lower distal end of the ejector rod is mounted through the top of an associated golf ball receiving cup to receive a golf ball and tee member therewithin. Downward projection of the support rod effects pivotment of the golf ball receiving cup within the housing, and projection of the ejector rod within the support rod effects projection of the golf ball and associated tee member exteriorly of the golf ball receiving cup.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art Who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf ball teeing apparatus which has all the advantages of the prior art golf ball teeing apparatus and none of the disadvantages.

It is another object of the present invention to provide a new and improved golf ball teeing apparatus which may be easily and efficiently manufactured and marketed.

It is a further object of the present invention to provide a new and improved golf ball teeing apparatus which is of a durable and reliable construction.

An even further object of the present invention is to provide a new and improved golf ball teeing apparatus which is susceptible of a low cost of manufacture with regard to both materials and labor, and which accordingly is then susceptible of low prices of sale to the consuming public, thereby making such golf ball teeing apparatus economically available to the buying public.

Still yet another object of the present invention is to provide a new and improved golf ball teeing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
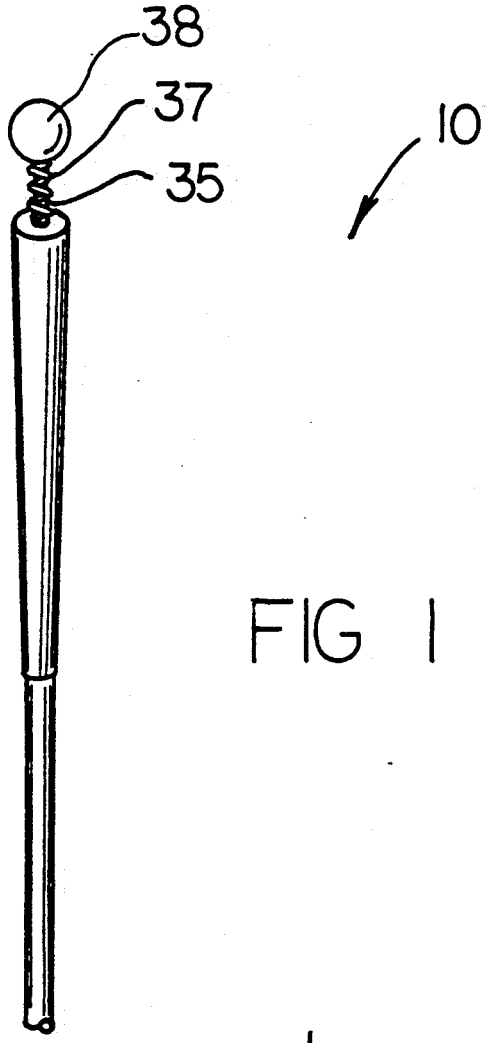
FIG. 1 is an isometric illustration of the handle structure of the invention.
Figure 2:
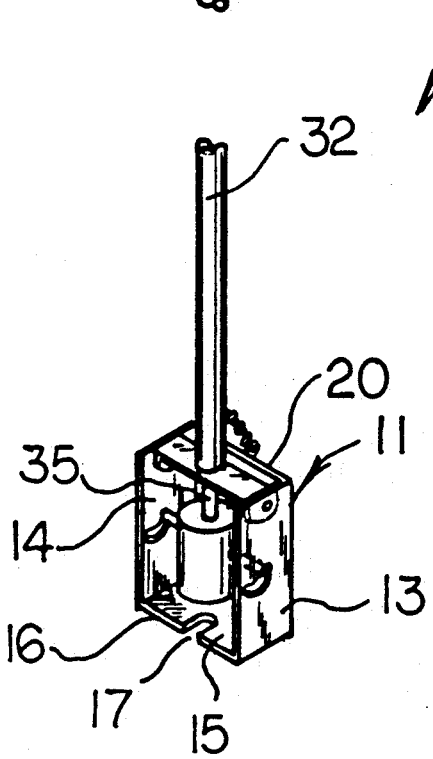
FIG. 2 is an isometric illustration of the body and ejector rod structure of the invention.
Figure 3:
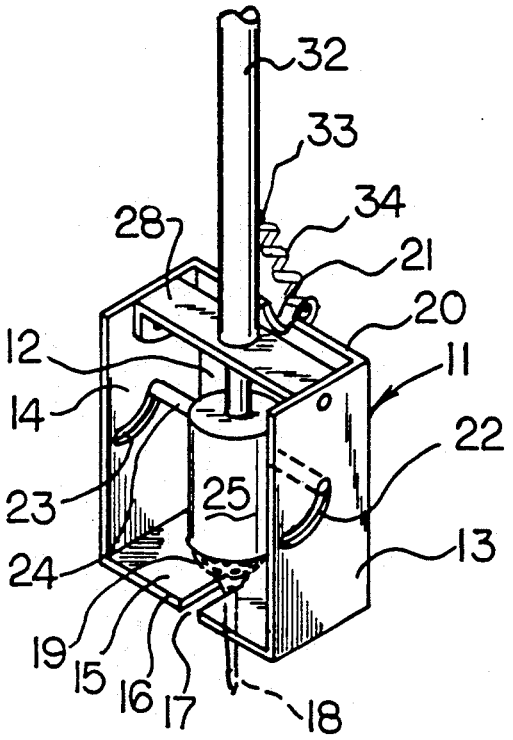
FIG. 3 is an enlarged isometric illustration of the housing structure of the invention.
Figure 4:
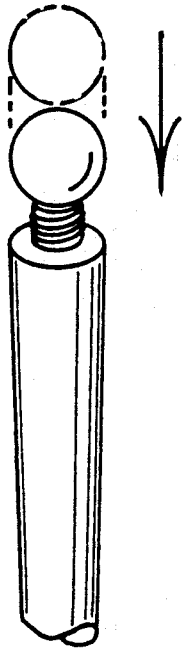
FIG. 4 is an enlarged isometric illustration of the handle structure utilized by the invention.

With reference now to the drawings, and in particular to FIGS. 1 to 8 thereof, a new and improved golf ball teeing apparatus embodying the principles and concepts of the present invention and generally designated by the reference numeral 10 will be described.

Figure 5:
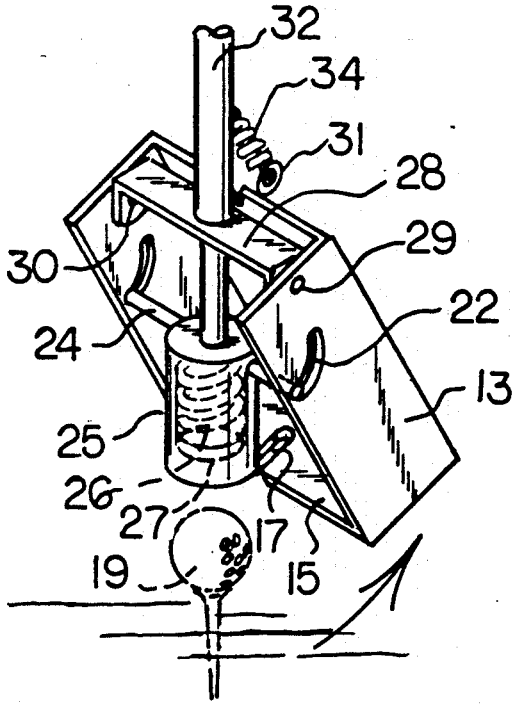
FIG. 5 is an isometric illustration of the invention in use.
Figure 6:
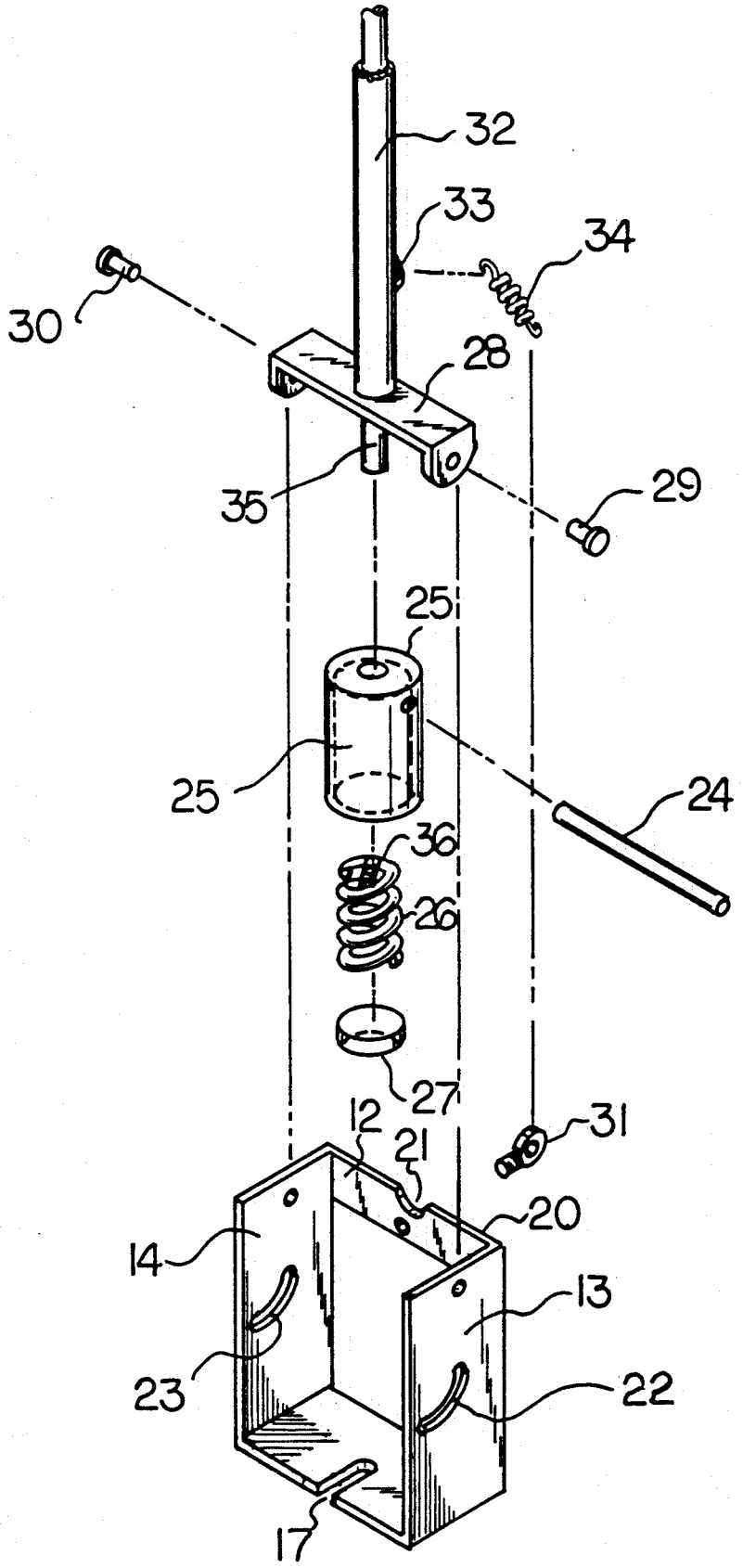
FIG. 6 is an isometric exploded illustration of the invention.

More specifically, the golf ball teeing apparatus 10 of the instant invention essentially comprises a ball support housing 11, including a rear wall plate 12, a first side wall 13 spaced from and parallel a second side wall 14, with a floor 15 mounted orthogonally between the first and second side walls 13 and 14 at lower distal ends of the respective side walls. The floor 15 includes a floor front edge 16, with a floor slot 17 directed medially and orthogonally relative to the floor front edge 16, with the slot defined by a slot length less than a width defined by the floor. A golf tee 18 is directed through the slot, with a golf ball 19 mounted thereon in use of the organization. The rear wall plate 12 includes a rear wall top edge 20 formed with an arcuate recess 21 arranged to accommodate the support rod 32 when the housing 11 is pivoted rearwardly, in a manner as illustrated in FIG. 5. A first side wall semicircular slot 22 and a second side wall semi-circular slot 23 formed in respective first and second side walls 13 and 14 are arranged in an aligned and parallel relationship relative to one another through the side walls to receive a slot axle 24 therethrough. The slot axle 24 is fixedly mounted adjacent an upper distal end of a golf ball receiving cup 25 of a cylindrical configuration, Wherein the slot axle 24 is diametrically directed through the cup at its upper distal end to be received within the aligned semi-circular slots 22 and 23 as the arcuate slots extend adjacent a forward edge of each respective side wall upwardly relative to a top edge of each respective side wall, as illustrated. The golf ball receiving cup 25 includes a cup spring 26 mounted therewithin, with a spring plate 27 mounted at a lower distal end of the cup spring 26 to receive the golf ball 19, whereupon an ejector rod 35 telescopingly and slidably directed through the support rod 32 mounted to a rod mounting bar 36 at an upper distal end of the cup spring 26 effects ejection of the golf ball 19 relative to the cup subsequent to rotation of the housing 11 relative to the cylindrical golf ball receiving cup 25. A pivot bracket 28 accordingly fixedly and orthogonally mounts the lower distal end of the support rod 32 medially thereof, with a pivot bracket first axle 29 orthogonally directed through the first side wall adjacent its upper edge, and a pivot bracket second pivot axle 30 orthogonally directed through the second side wall adjacent its upper edge to permit pivotment of the pivot bracket 28 and accordingly permit travel of the slot axle 24 along the associated first and second slots 22 and 23, as illustrated in the FIG. 5.

A rear wall plate spring anchor 31 mounted medially of the rear wall plate 12 cooperates with a support rod spring anchor 32 to secure a return spring 34 therebetween to bias the housing 11 in a displaced orientation relative to the cup 25 to displace the cup relative to the floor 15. An ejector rod return spring 37 is mounted between an upper distal end of the support rod 32 and an ejector rod handle 38 to bias the ejector rod in a raised orientation to require an individual to compress the return spring 37 in ejection of the golf ball and tee 19 and 18 respectively.

Figure 7:
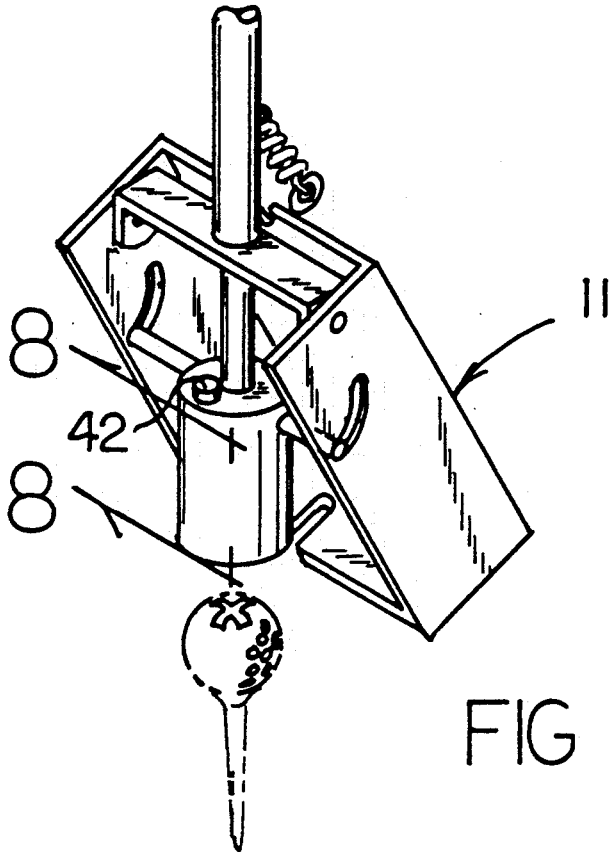
FIG. 7 is an isometric illustration of a modification of the invention utilizing a golf ball marker device.
Figure 8:
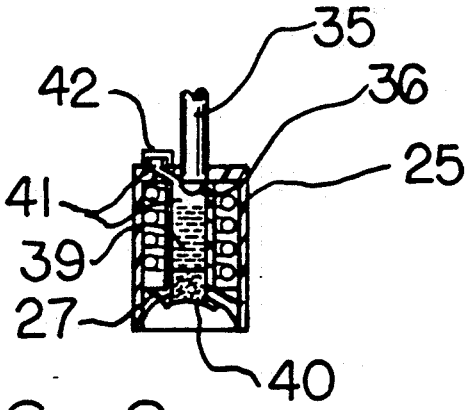
FIG. 8 is an orthographic view, taken along the lines 8—8 of FIG. 7 in the direction indicated by the arrows.

The FIGS. 7 and 8 illustrate the use of an optional ink reservoir 39 mounted within the cup 25 that cooperates with an ink stamp 40 mounted at a lower distal end of the reservoir, with the ink stamp 40 formed medially through the cup spring plate 27, with a reservoir fill conduit 41 effecting selective filling of the reservoir 39 through an opening 42 and an associated plug. Upon downward projection of the cup spring plate 27, a marking is placed upon the associated golf ball 19 to permit ease of identification of the golf ball and permit its retrieval when confusion may arise as to the ownership of golf balls typically created during play on crowded golf courses.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf ball teeing apparatus comprising in combination, a ball support housing having a first upwardly extending side wall spaced front and parallel to a second upwardly extending side wall; a rear, wall plate orthoginally and fixedly attached to said between said first and second side walls;

said housing further having a floor mounted between said first and second side walls, said floor having a front edge spaced forwardly of said rear wall and having an elongated floor slot, said floor slot being oriented medially and orthogonally relative to said floor front edge, said floor slot having a predetermined length, and said floor having a predetermined width, said predetermined length being less than said predetermined width; a bracket pivotally mounted to, between and adjacent an upper end of said first and second side walls, wherein said pivot bracket includes first and second coaxial axes orthogonally extending though respective said first and second side walls;

a tubular support rod having a lower end thereof attached orthogonally to and medially of said support bracket, said support rod further having an ejection rod telescopically and slidably extending therethrough, said ejection rod having a handle attached at an upper end thereof;

an ejection rod return spring positioned between said handle and an upper end of said support for biasing said ejection rod handle away from said support rod upper end;

a cylindrical golf ball receiving cup being mounted on a lower end of said ejection rod between said first and second side walls and below said bracket, the longitudinal axis of said ejection rod being coaxial with the longitudinal central axis of said receiving cup, a cup spring, said cup spring being positioned in said receiving cup and having one of its ends attached to said lower end of said ejection rod, said cup spring having a ball engaging plate attached to its other end, said plate being positioned within said receiving cup, said cup spring being compressed when a golf ball and ball supported tee is placed between said plate and said housing floor, said spring slot receiving the shaft of a tee having a ball support head and a ground engaging shaft, and said spring will expand subsequent to rotation of said housing relative to said receiving cup to thereby release the ball and tee from said teeing apparatus.

2. The teeing apparatus as defined in claim 1 wherein, said receiving cup includes a slot axle, said slot axle extending transversely through said receiving cup, said first side wall having a first semi-circular slot intermediate its ends and said second wall having a second semi-circular slot intermediate its ends, said first and second semi-circular slots being parallel and aligned relative to each other, said slot axle further extending through said first and second semi-circular slots.

3. The teeing apparatus as defined in claim 2 wherein, said rear wall plate has a top edge and a top edge recess, said recess being positioned to receive said support rod when said housing is pivoted relative to said to said receiving cup, said support rod having a first spring anchor and said rear wall plate having a second spring anchor, and elongated spring extending between and attached to said first and second spring anchors to bias said housing in a displaced orientation relative to said receiving cup.

4. The teeing apparatus as defined in claim 3 wherein, said ball receiving cup includes an ink dispensing reservoir mounted therein, said ball engaging plate includes an ink stamp in fluid communication with said reservoir to effect imprinting identifying indicia on a golf ball positioned in said receiving cup.

* * * * *